United States Patent [19]

Webber

[11] 4,190,108

[45] Feb. 26, 1980

[54] SWAB

[76] Inventor: Jack C. Webber, 1721 Blalock, Houston, Tex. 77055

[21] Appl. No.: 925,987

[22] Filed: Jul. 19, 1978

[51] Int. Cl.[2] ..... E21B 37/00

[52] U.S. Cl. ..... 166/202; 92/254; 417/555 A

[58] Field of Search ..... 166/202; 92/241, 254; 417/555 A

[56] References Cited

U.S. PATENT DOCUMENTS

| | | | |
|---|---|---|---|
| 2,456,551 | 12/1948 | Wilson | 92/241 |
| 2,723,721 | 11/1955 | Corsette | 417/555 A UX |
| 2,887,347 | 5/1959 | Losey | 106/202 UX |
| 2,965,422 | 12/1960 | Wilson | 92/241 UX |
| 3,677,143 | 7/1972 | Crickner | 92/241 |
| 4,099,451 | 7/1978 | Blackwell | 166/202 |

*Primary Examiner*—William F. Pate, III

*Attorney, Agent, or Firm*—Vinson & Elkins

[57] ABSTRACT

This patent application discloses a swab mandrel having thereon a swab with reinforcing wires imbedded at approximately the mid-point of the wall of the swab for a substantial distance to permit the swab to have fluid film lubrication with the tubing in which the wires at the upper end of the swab are approximately at the outer diameter of the swab and are sled shaped to bridge couplings in a tubing. The swab further has a restraining ring around the lower end thereof which supports the body of resilient material and restrains outward movement but is spaced from the wires to permit the wires to move radially outward a limited distance. To insure that a proper support is provided for the swab both above and below a special two piece support is provided for engagement with the bottom of the swab and with the top of the reinforcing wires.

21 Claims, 1 Drawing Figure

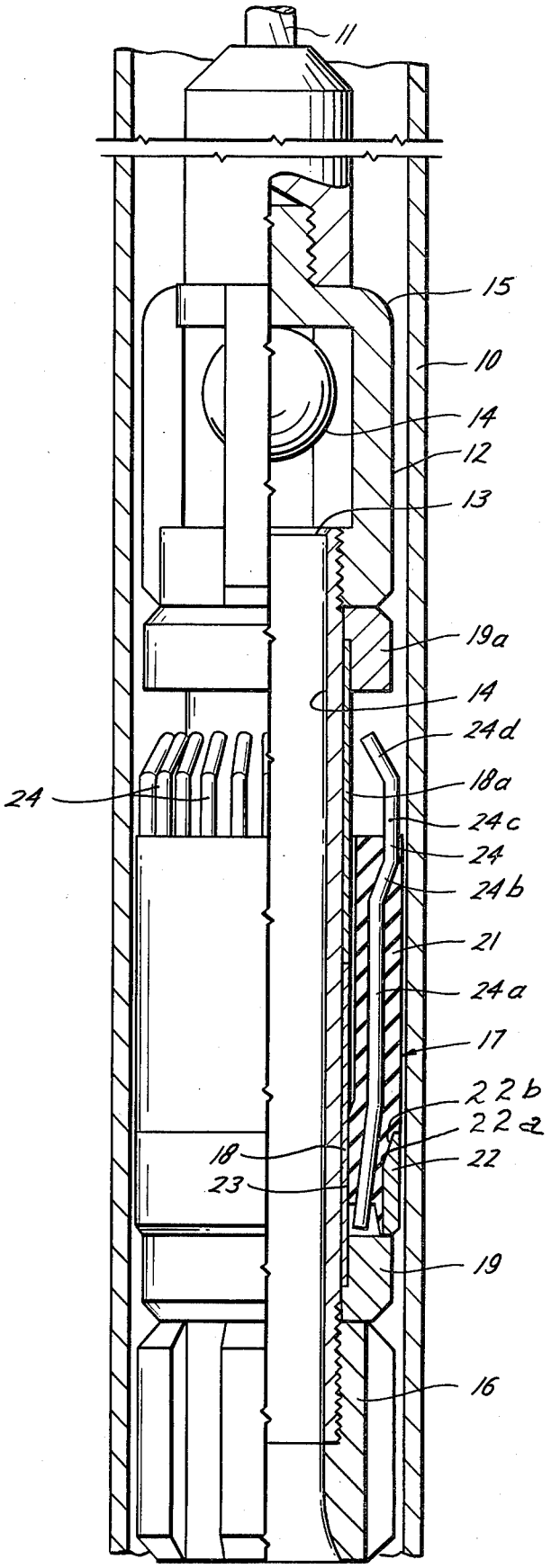
11
15
10
14
12
13
19a
14
24d
18a
24
24c
24
24b
21
24a
17
22b
22a
22
18
23
19
16

SWAB

This invention relates to well swabs.

Swabs are a common tool in petroleum wells and are frequently used to lift liquids from substantial distances down in the earth. As the load of liquid above the swab may be several hundred pounds, it is important to reduce the effect of friction between the swab and the tubing as it is moving in the tubing. Due to the load imposed on the swab it is also desirable to reinforce the resilient body of the swab with reinforcing rods. These rods preferably should support the resilient material in a vertical direction while permitting the swab to expand radially to engage the tubing through which it is moving. It is further desirable to protect the swab cup against hanging up in the spaces in the tubing which occur every thirty feet where the sections of tubing are coupled together.

If the load carrying portion of the swab engages the wall of the well with substantially nothing but the resilient material during the useful life of the swab, then the swab will be lubricated by a film of fluid between the resilient material and the wall of the well which will greatly reduce friction between the swab and well and thus greatly prolong the life of the swab.

If the design is such that the reinforcing wires bear lightly against the pipe, the wire wear is greatly reduced thus reducing the incident of wire breakage and resulting sticking of the cup in the well.

A problem is sometimes encountered in getting a swab down into a well as the tubing frequently is not straight and contains oval sections or other tight places. Thus, it is desirable to have a swab which is of a small diameter to permit it to fall freely while at the same time being constructed to expand readily into engagement with the tubing when swabbing.

Well swabs have been used for many years but so far as is known none have the advantages of this invention. Cup-type swabs having imbedded wires are old and well known. See, for instance, the patents to Taylor, U.S. Pat. Nos. 2,581,981 and 2,917,352. While the latter patent shows a sled portion for negotiating couplings, the wires have sections at the outer periphery of the cups and these wires would rub against the tubing with great force during swabbing. Riley U.S. Pat. No. 3,150,607 is another example of a cup-type swab with wires which will bridge a crevasse but which rub with great force against the tubing during swabbing. Crickmer 3,667,143 has a double row of wire reinforcement in which the outer row of wires rubs against the tubing during swabbing. U.S. Pat. Nos. Stowe 3,448,987, Corsette 2,723,721, and Hartmann 1,643,199, teach imbedding the reinforcing wires in the midsection of the resilient material of the swab but they do not provide sled portions of wire at the top of the cup to bridge crevasses in the tubing. Further, Hartmann is the only one of the above references in which the wires are free to float at their lower ends to permit the cup to freely expand radially at the lower end of the cup.

It is an object of this invention to provide a swab which is smaller in diameter than most conventional swabs so that it will fall better, which will have substantial radial flexibility so that softer compounds of resilient materials may be used and yet is fully reinforced so that the swab will lift both light and heavy loads.

It is another object to provide a swab cup which is reinforced with wires which have sled portions to bridge gaps in the tubing which have the remainder of the wires deeply imbedded in the wall of the resilient material so that they do not engage the tubing, and in which the lower ends of the wires are permitted to move radially outward to a limited extent so that the cup can freely expand out into engagement with the wall of the tubing.

It is another object of this invention to provide a swab cup which can lift both light and heavy loads and in which the cup runs with fluid film lubrication on the sealing portion of the cup and does not drag wires against the tubing under heavy loads while providing for bridging sled portions in the upper ends of the wires to prevent the cup from hanging up at the couplings on the tubing.

Another object is to provide a swab with minimum frictional engagement with the tubing to permit it to pull easier with the same load and thus save power as well as lengthening the life of the swab.

Another object is to provide a cup-type swab in which there is no bumping of the swab at couplings.

Another object is to provide a reinforced cup-type swab which may pull heavy or light loads which is fabricated of relatively soft, flexible, resilient material and will virtually recover the full load above the swab.

Another object is to provide a cup-type swab in which minimum contact is provided between the wires and tubing to approximate all rubber cups in overall safety.

Other objects, features and advantages of the invention will be apparent from the Drawing, the Specification and the Claims.

In the Drawing, the single FIGURE shows a well tubing in section having therein a swab cup mounted on a swab mandrel with the mandrel and cup shown partly in elevation and partly in quarter section. The tubing 10 illustrated in the Drawing is representative of a petroleum well tubing in which well swabs are conventionally run.

The swab is run on a wireline 11 and there is shown a conventional swab mandrel 12 which includes the back check provided be seat 13 and ball 14 within the cage 15. The mandrel body is tubular in form as shown at 14 so that when the swab is run the ball 14 is in the position illustrated in the Drawing and fluid passes through the body 14 past the seat 13 and out through cage 15, thus permitting the swab to fall in the well. The swab mandrel is completed by the nut 16 on the lower end of the tubular body portion 14. The conventional X-section mandrel may also be utilized. It will be understood that the length of the tubular body portion 14 may vary and that where a longer body portion is utilized more than one swab may be provided on the mandrel in the conventional manner if desired.

If the mandrel provided suitable support surfaces at its opposite ends the swab cup indicated generally at 17 could be run directly on the mandrel. Operators utilize their own mandrels and cups from many sources and it is preferred to provide a separate support for the swab cup to insure that it operates in the proper manner. For this purpose a lower support is provided by the sleeve 18 having at its lower end the outwardly extending ring or flange 19. The ring is sized to fit a conventional mandrel and to have a radial extend to support the swab cup 17 during the swabbing operation.

Preferably, an upper support is also provided which includes a tubular sleeve like member **18*a* with an outwardly extending ring or flange 19*a*. Preferably, the upper and lower supports just described are identical so that they may be interchanged by the operator. It will be noted that the particular mandrel illustrated is so constructed that the upper support could be dispensed with as the lower surface of cage 15 would engage the top of the swab cup 17** during running of the swab if desired. The upper member is provided to insure that there is present a surface for engagement with the upper end of the cup during running thereof without damage to the cup.

The cup 17 includes a sleeve shaped body 21 of resilient material. Preferably, the inner and outer diameter of the body are substantially constant down to a point adjacent ring 22. In the area of ring 22 the outer diameter of the body is reduced to accommodate the ring 22. The inner diameter of the body is slightly reduced at 23 to engage the sleeve 18 of the lower support and center the swab. This is desirable to prevent problems as the cup passes upwardly through the well head. The additional material above the ring 22 also increases wall thickness above ring 22 at the point of maximum wear to protect against blowout at this point. If a lower support is not used the body will compress to engage the mandrel or a sleeve without a lower flange could be used.

The body is designed to run with fluid film lubrication over most of its length, and has an adequate length for this purpose. By providing a design which utilizes fluid film lubrication the frictional resistance to movement of the cup through the tubing is greatly reduced. This results in less wear on the cup and less power required to lift a given load.

Providing support for the resilient body 21 are a plurality of wires 24 which extend the entire length of the body in the illustrated embodiment. These wires are arranged circumferentially about the cup and spaced equidistant from each other. In accordance with this invention the principal portion of the wires which is imbedded within the resilient material 21 is spaced inwardly from the outer periphery of the body 21 so as to not interfere with the fluid film lubrication and to not engage the wall of the tubing. If the wires engaged the tubing in this area of the cup the frictional drag would be greatly increased.

Each wire 24 includes a lower section **24*a* which extends upwardly through a substantial length of the body. Above this point the lower intermediate section of the wire 24*b* angles outwardly to position the upper intermediate portion of the wire 24*c* at approximately the outer diameter of the cup body 21. Above the upper intermediate portion the top portion 24*d* of the wires angles inwardly to avoid the wires catching on the tubing, particularly at joints or collars. The upper intermediate portion 24*c* and top portion 24*d* of the wires provides a sled-like structure which will bridge the space between joints of tubing where they are connected together, as by couplings. As the body 21 comes up to approximately the juncture between the lower intermediate portion of the wire 24*b* and the upper intermediate portion of the wire 24*c* the support for the body 21 begins at this bridging section of the wires and the wires thus act in cantilever fashion to prevent the body 21** from bulging outwardly as a crevasse in the tubing is being crossed to prevent the body from extruding out into the crevasse and being damaged therein. Couplings between tubings result in such a crevasse approximately every thirty feet. The design of the cup of this invention is such that the operator cannot feel the coupling as the swab is pulled up the tubing.

It will be noted that except with very light loads, the portion **24*c* of the wires which contact the tubing bear very lightly against the pipe. The principal load carrying portion of the cup is below the upper intermediate section 24*c* of the wires and thus the load exerted radially on the cup is below section 24*c* of the wires and the frictional load between section 24*c*** of the wires and the tubing is very small. This priniciple reduces the wear on the wires and thus virtually eliminates wire breakage and sticking due to wire wear.

The relationship of the radial dimension of the wires and the material of the cup and the relative arrangement are preferably arranged such that the radial dimension of the wire and the radial dimension of the cup inside and outside of the wire in a radial direction are approximately equal. In the illustrated form the outer section of the cup and wires are approximately equal and the inner section of the cup is approximately two-thirds of the wire width. This will give adequate resilient material radially outward from the wires to provide the fluid film lubrication and will give adequate material for providing a long wear life for the cup. The material is also thick enough that the supporting forces from individual wires and spread fairly evenly about the periphery of the cup.

In a two inch swab it is preferred to utilize twenty-four 0.120" diameter wires. It is noted that while round wires are illustrated, other shapes such as square wires could be utilized. With the round wires of the stated diameter there is preferably 0.110" of material of the body radially outward from the lower section **24*a* of the wires throughout most of the length of the body. Along this section of the body the radial dimension of the innermost section of the wall of the body 21** is 0.080". This amount of material internally of the wires is sufficient to preclude blowing through the wires under load and give satisfactory material for molding. The amount of material inwardly from the wires could be less and give the function of preventing blowing through the wires but the slight increase to about the stated dimension give some tolerance in the molding procedure and permits acceptance of cups with slight molding flaws.

At the lower end of the cup a retaining ring 22 is provided which supports and retains the lower end of the cup. This ring is preferably spaced radially from the lower end of the wires 24 to permit radial outward movement of the wires when the cup is under load. The ring 22 might take any form such as the ring-like structure shown or it might be a bushing with oversized holes or holes which are oval with their major dimension extending radially. The purpose in either case would be to permit the wires to move radially outward under load so that the wires do not unduly restrain the ability of the body of resilient material to expand radially into contact with the tubing.

The wires may be restrained against movement in a radial direction by pivoting the wires at the restraining ring 22. That is the wires would engage the inner surface of the ring 22 and turn about the circumferentially extending edge **22*a* provided by the chamfer 22*b*. This would result in the wires moving outwardly immediately above ring 22 in substantially the same manner as when the wires are spaced from the ring 22. It may be found that the cup would need to be slightly longer to obtain the desired length of cup for fluid film lubrication. It has been found that in some cases the lower ends of the wires have scored the sleeve 23 indicating that the wires first move out and then pivot about the circumferential edge 22a**.

It will be noted that the ring 22, the body of material 21, and the upper intermediate section 24c of the wires are all positioned so that the outer peripheral surface of these parts are approximately at the same diameter. With the design illustrated the cup can be slightly less in diameter than other conventional wire supported cups which will permit the cup to go down into the well faster and to negotiate tight spots in the tubing with greater ease.

It will be noted that the wires 24 at their lower ends are in a space. This is due to a wire supporting mold part being used at this point during the molding procedure. It will also be noted that the wires terminate a slight distance above the ring 22. This is to insure that the wires do not inhibit the ability of the ring 22 to seat on the flange 19 of the lower support and provide a metal-to-metal seat at this point. It might also be noted that a metal-to-metal seat is provided between the support 19 and the nut 16 on the mandrel. It should also be noted that the body 21 extends down to the bottom of the ring 22. While this is not necesssary it is preferable as the resilient material will assist the ring in providing a seal with the support member 19.

For clarity of disclosure the body 21 is shown to terminate at the lower portion of the upper intermediate section 24c of the wires. In the commercial form of this cup a gear-like member is utilized at the top of the cup during the molding procedure. The lands of the gear extend between the several wires to hold them in the proper relationship. This results in the body 21 actually extending up to the top of the wires and inwardly from the wires along the section of the wires above the body as shown in the drawing. However, the gear-like mold member extends between each pair of adjacent wires and there is no resilient material at this point other than a film of material which may sometimes extend around the entire outer periphery of the wires at this point. This resilient material above the point shown in the drawing is non-functional and thus has been omitted for clarity of understanding the invention. While the mold system which has been utilized with the swab of this invention results in the deposit of non-functional material at the top section of the wires, it will be appreciated that other mold design might readily avoid leaving resilient material above the point of the resilient material shown in the Drawing. In any event material above this point is not functional as it is not continuous about the entire wall of the cup.

From the above it will be appreciated that the swab cup can be made smaller than the conventional wire supported cup. Then with both ends of the supporting wires being free to move radially on the bottom end to pivot the cup can readily expand radially into engagement with the tubing when under load. When the cup is expanded into engagement with the wall of a tubing the upper intermediate section 24c of the wires bridges any gap or crevasse in the tubing and provides cantilever support for the resilient body of the cup to prevent or lessen the probability of damage as the cup passes a crevasse in the tubing.

The foregoing disclosure and description of the invention are illustrated and explanatory thereof and various changes in the size, shape and materials, as well as in the details of the illustrated construction, may be made within the scope of the appended Claims without departing from the spirit of the invention.

What is claimed is:

1. A swab cup comprising, a sleeve shaped body of resilient material with circumferentially spaced reinforcing wires, all of said wires spaced inwardly from the outer diameter of the body along a major portion of its length to permit the body to have fluid film lubrication with a tubing, said wires at their upper sections having sled portions at the outer diameter of the cup for engaging the wall of a tubing and bridging couplings in the tubing, and a restraining ring at the lower end of the cup limiting radial movement of the wires within the ring while permitting limited outward movement of the wires above the ring.

2. The cup of claim 1 in combination with a lower support having a sleeve section in said body and a flange section extending rigidly outward from the sleeve and engaging the lower surface of said ring.

3. The cup of claim 2 in combination with an upper support having a sleeve section in said body and a flange section extending rigidly outward from the sleeve and overlying the upper ends of said wires.

4. The cup of claims 1, 2 or 3 in combination with a swab mandrel.

5. The cup of claim 1 wherein the radial dimension of the body outside said wires at said major portion of its length and the radial dimension of said wires is substantially equal and the radial dimension of the body inside the wires is approximately two-thirds the radial dimension of the wires.

6. The cup of claim 1 wherein the wires extend the full length of the body.

7. A swab cup comprising, a sleeve-shaped body of resilient material, a plurality of wires extending lengthwise of and equally spaced about the body, each wire having a lower portion extending through a substantial length of the body at approximately the radial midpoint of the wall of the body, and an intermediate portion at the upper section of the body with its outer surface approximately in a plane tangent to the outer surface of the body, and an upper portion angled inwardly, and a rigid ring surrounding the lower end of the body and the lower ends of the wires and spaced radially from the wires to permit limited outward movement of the wires.

8. The cup of claim 7 in combination with a lower support having a sleeve section in said body and a flange section extending radially outward from the sleeve and engaging the lower surface of said ring.

9. The cup of claim 8 in combination with an upper support having a sleeve section in said body and a flange section extending radially outward from the sleeve and overlying the upper ends of said wires.

10. The cup of claims 7, 8 or 9 in combination with a swab mandrel.

11. The cup of claim 7 wherein the radial dimension of the lower portion of said wires and the material of the body outside the wires is substantially equal and the material of the body inside the wires is approximately two-thirds the radial dimension of the wires.

12. The cup of claim 7 wherein the wires extend the full length of the body.

13. A swab cup comprising, a plurality of equally spaced reinforcing wires arranged in a circle, each wire having a lower section extending upwardly, a lower intermediate section extending outwardly, an upper intermediate section extending upwardly, and an upper section extending inwardly, a sleeve-like body of resilient material covering substantially all of the lower sections of the wires with the wire imbedded at approximately the mid-point of the wall of the body, and a ring of reinforcing material surrounding the lower end of said body and the lower end of each wire and spaced from each wire to permit limited radial expansion of said wires, said ring and body thereabove having approximately the same diameter as the upper intermediate section of said wires.

14. The cup of claim 13 in combination with a lower support having a sleeve section in said body and a flange section extending radially outward from the sleeve and engaging the lower surface of said ring.

15. The cup of claim 14 in combination with an upper support having a sleeve section in said body and a flange section extending radially outward from the sleeve and overlying the upper ends of said wires.

16. The cup of claims 13, 14 or 15 in combination with a swab mandrel.

17. The cup of claim 13 wherein the radial dimension of the lower section of said wires and the material of the body outside said section of the wires is substantially equal and the material of the body inside the wires is approximately two-thirds the radial dimension of the wires.

18. The cup of claim 13 wherein the wires extend the full length of the body.

19. A swab cup comprising, a sleeve shaped body of resilient material with circumferentially spaced reinforcing wires spaced inwardly from the outer diameter of the body along a major portion of its length to permit the body to have fluid film lubrication with a tubing, said wires at their upper sections having sled portions at the outer diameter of the cup for engaging the wall of a tubing and bridging couplings in the tubing, and a restraining ring at the lower end of the cup having a circumferentially extending surface which limits radial outward movement of said wires.

20. The cup of claim 19 wherein the wires are spaced from said surface and move radially outward until restrained by said surface and then pivot about said surface.

21. The cup of claim 19 wherein said wires pivot about said surface.

* * * * *